US006475032B1

(12) United States Patent
Dvorak

(10) Patent No.: US 6,475,032 B1
(45) Date of Patent: Nov. 5, 2002

(54) GEOPHYSICAL CONNECTOR

(75) Inventor: David L. Dvorak, Kingwood, TX (US)

(73) Assignee: Houston Connector, Inc., New Caney, TX (US)

( * ) Notice: Subject to any disclaimer, the term of this patent is extended or adjusted under 35 U.S.C. 154(b) by 0 days.

(21) Appl. No.: 09/874,971

(22) Filed: Jun. 7, 2001

(51) Int. Cl.[7] ..... H01R 13/58
(52) U.S. Cl. ..... 439/606; 439/638; 439/624
(58) Field of Search ..... 439/606, 284, 439/638

(56) References Cited

U.S. PATENT DOCUMENTS 3,905,668 A * 9/1975 Gee ..... 439/587
4,445,741 A 5/1984 Annoot ..... 439/290
4,477,136 A 10/1984 Smith ..... 439/289
4,720,267 A * 1/1988 De Jong ..... 439/279
4,917,632 A * 4/1990 Smith ..... 439/278
5,199,893 A * 4/1993 Fussell ..... 439/271
5,984,724 A 11/1999 McNeel ..... 439/606
6,165,013 A * 12/2000 Broussard ..... 174/110 SR

* cited by examiner

*Primary Examiner*—Tulsidas Patel
(74) *Attorney, Agent, or Firm*—Richard C. Litman

(57) ABSTRACT

A geophysical connector features a combination of male and female connectors in a single plastic injection molded part. The single injection molding process allows two connectors to be manufactured simultaneously, rather than separately. The design provides higher efficiency in the manufacturing process, and lowers the cost of a traditional male/female connector subassembly, resulting in fewer rejects and a more consistent quality product. The durability of the product connector is increased as a continuous wiring circuit is created which is uninterrupted between lead line and the connectors, as opposed to splicing one connector into the lead line to a geophone.

14 Claims, 9 Drawing Sheets

GEOPHYSICAL CONNECTOR

BACKGROUND OF THE INVENTION

1. Field of the Invention

The present invention relates to electrical connectors. More particularly, the present invention relates to an improved connector for geophysical devices.

2. Description of the Related Art

Presently, a widely used geophysical device requires a two-piece, two wire connector having a male part and a female part and a two-wire lead line leading to a geophone. Presently a subassembly is employed, having the male part at the termination point of the two wire lead line and the female part is spliced into the lead line at a spaced point along the lead line relative to the male part. It is presently impractical to manufacture a standard subassembly since differing lengths of lead line are required, so splicing is the only practical approach to manufacture, requiring two connector molding steps. This custom manufacturing approach results in many subassembly rejections. It would be desirable to have a connector design which avoids the two step custom molded assembly approach presently employed. It would also be desirable to maintain the lead line in a linear configuration through the connector to avoid damage to the connector under lead line tension force which may be applied during handling.

U.S. Pat. No. 4,445,741, issued May 1, 1984, to Annoot describes a double plug seismic connector having a male connector plug at one end of the body and a female plug at the other end of the body. The '741 patent requires the lead line to enter the connector at an angle relative to the outlet connector, thus making it subject to failure due to tensile forces on the lead line applied during handling.

U.S. Pat. No. 5,984,724, issued Nov. 16, 1984, to McNeel describes a seismic cable connector having alternate male and female lead connectors to avoid mistake in the connecting of the connector parts. The '984 patent is directed to a single plug connector, rather than the double plug connector of the present invention.

U.S. Pat. No. 4,477,136, issued Oct. 16, 1984, to Smith describes a seismic cable connector with a male plug and a female socket in a side-by-side relationship in an elastomeric material casing. The '136 patent places both the male plug and the female plug immediately adjacent, which could cause problems in the connection process due to small clearances, as opposed to the present invention which has a male plug at an opposite end of the plug body from a female plug.

None of the above inventions and patents, taken either singularly or in combination, is seen to describe the instant invention as claimed. Thus, an improved geophysical connector solving the aforementioned problems is desired.

SUMMARY OF THE INVENTION

An improved electrical connector for geophysical apparatus features a combination of male and female connectors in a single plastic injection molded part. The single injection molding process allows two connectors to be manufactured simultaneously, rather than separately. The design provides higher efficiency in the manufacturing process, and lowers the cost of a traditional male/female connector subassembly, resulting in fewer rejects and a more consistent quality product. The durability of the product connector is increased as a continuous wiring circuit is created which is uninterrupted between the lead line and the connectors, as opposed to splicing one connector into the lead line. The inventive connector is specifically directed for use in place of the LRS-5517 geophone connector assembly presently available from Houston Connector Inc., New Caney Tex., as well as other geophysical equipment companies.

Accordingly, it is a principal object of the invention to provide a method of combining LRS-5517 geophone connector assembly connectors into a single injection molded unit.

It is another object of the invention to provide a single plastic injection plug which takes the place of the two injection plastic male connector and spliced female connector assembly of the LRS-5517 geophone connector.

It is a further object of the invention to provide a single plastic injection plug having a male plug and a female plug at opposing ends of the plug body.

Still another object of the invention is to provide a single plastic injection plug as above incorporating preestablished circuitry as opposed to after the fact splicing in of the female plug to the lead line of a geophone.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention is an improved geophysical connector whose unique attributes provide a substantial degree of benefit to the end user of LRS type geophysical connectors. The LRS connector arrangement that is presently widely used on geophysical cables and equipment has been substantially improved upon by the present inventive connector. The LRS 5517 connector arrangement was developed many years ago by Litton Resources and has been established as a superior wet environment geophysical connector.

The LRS 5517 connector arrangement is presently manufactured by many geophysical equipment companies.

Figure 1A:
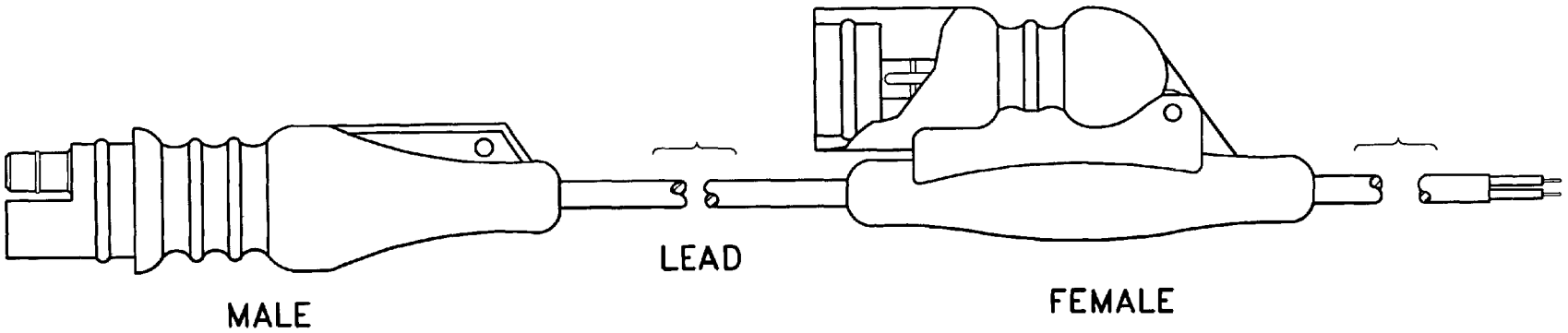
Fig. 1A (PRIOR ART)
FIG. 1A is a side elevation view of the prior art dual connector geophysical connector subassembly.
Figure 1B:
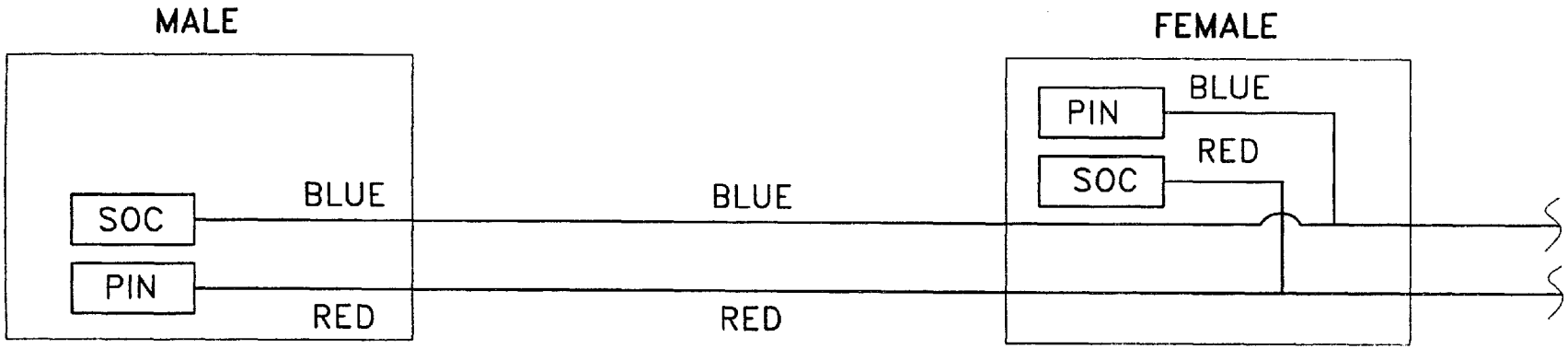
Fig. 1B (PRIOR ART)
FIG. 1B is an electrical diagram of the prior art subassembly of FIG. 1.
Figure 2:
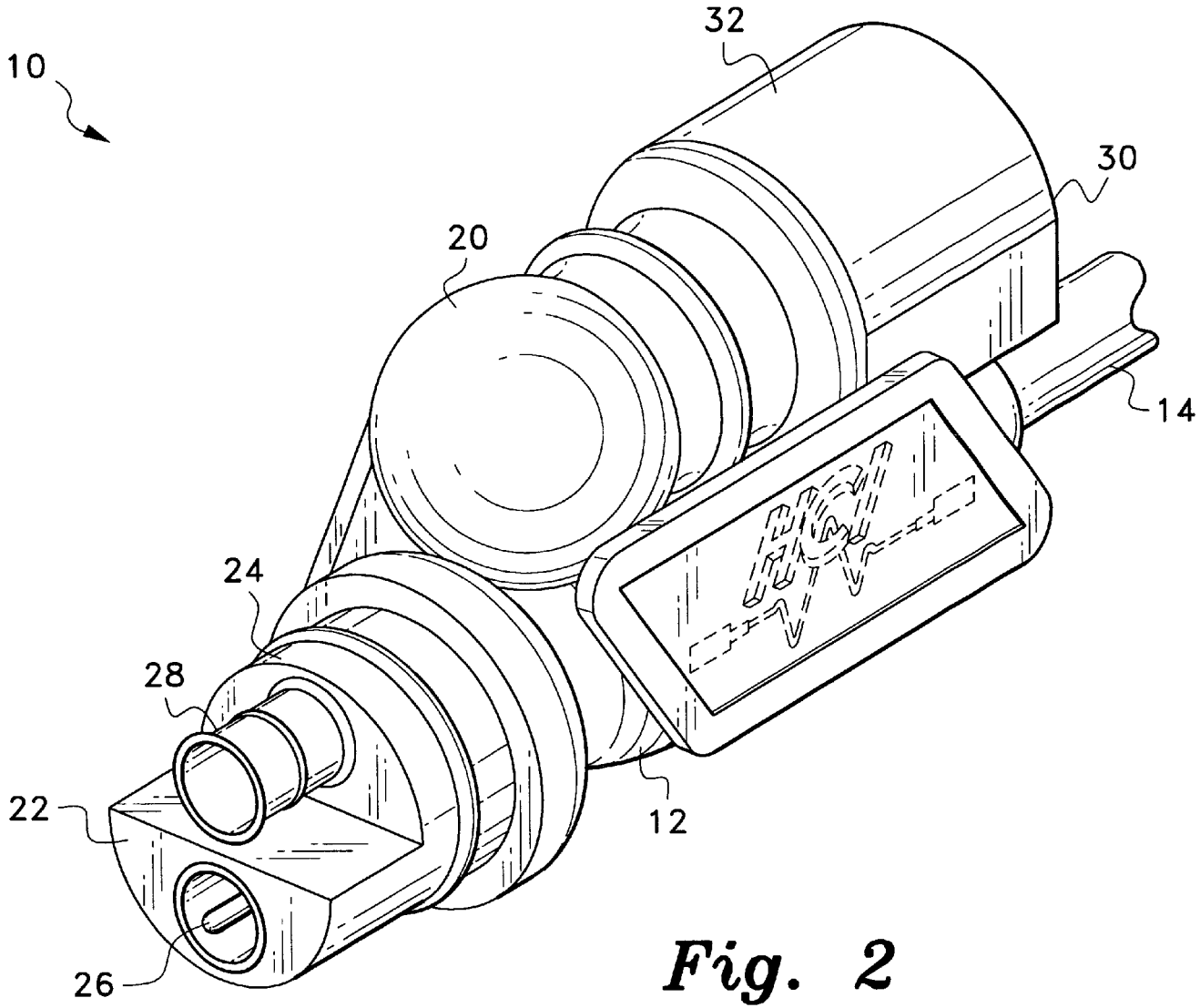
FIG. 2 is a perspective view of the inventive dual connector for geophysical apparatus.

Referring to FIGS. 1A and 1B, the LRS 5517 connector arrangement (prior art) is a two-piece connector having a male part and a female part with a lead wire connecting the two connectors.

This arrangement allows for connecting geophysical equipment with either gender without the use of adapters. The present invention combines the two parts used in the 5517 assembly(male and female connectors) into one molded component that serves all functions of the LRS 5517 connector. The 5517 geophone connector assembly has not previously been manufactured in a single part until the present invention. Incorporating both connectors of the 5517 assembly in a single injection molded part is the heart of the present invention.

The present inventive connector does essentially the same job as the LRS 5517 geophone connector assembly, but there are very important differences in how the inventive connector is manufactured as compared to the 5517. The inventive part design allows a cost efficient single plastic injection molding operation to form both the female and male connectors. The LRS 5517 is manufactured with two plastic molding operations. First a socket and pin contact assembly is over-molded on a lead wire to form the male connector. The lead wire is then connected to an additional socket and pin contact assembly and a second molding operation forms the female connector. The female connector molding operation is critical, if the female part is not properly formed when molded in the second molding operation, then the whole assembly must be rejected and the prior completed male connector is not useable. The lead wire of the male connector will be too short to meet specification if it is cut and removed from a rejected female part. Part rejection is 50% higher in the manufacture of 5517 arrangements as compared to the inventive connector. The inventive connector is efficient to produce, requiring less time, fewer molding operations, and a lower part rejection rate. The inventive design eliminates the lead wire used to connect male to female in the 5517 connector arrangement, further reducing material cost.

The inventive connector has a performance advantage over the traditional 5517 assembly because there is no lead wire required for connecting the male connector and the female connecter. The 5517 assembly typically is spliced within the female connector. It is not practical in production to manufacture the 5517 assembly without splicing, as there is no standard geophone cable type or length. The customer-specified geophone cable is cut to the specified length and spliced to the male connector at the female contacts. The inventive connector utilizes a continuous electrical conductor and is not spliced at any point between the male and female connectors, providing stronger connections. This wiring configuration reduces electrical continuity failure in field use. The lead wire on the 5517 assembly is often damaged by the chewing actions of animals in field use, which creates an electrical leakage to ground problem that can only be haphazardly corrected with splicing and electrical tape. The geophysical industry frowns on cable and leader with tape as it eventually becomes a source of electrical leakage.

The inventive connector has dust cap covers for the male and female connectors and the proximity of the connectors allows a single lanyard and two crimp sleeves to affix both dust caps. The 5517 assembly requires the installation of four crimp sleeves and two lanyards to affix both dust caps. Material and labor cost for dust cap installation are therefore lower for the inventive connector.

Referring to FIGS. 1A and 1B, there is shown a side elevation view and an electrical diagram of the prior art dual connector geophysical connector assembly, respectively.

Referring to FIGS. 2 and 3A–3E, geophysical dual connector 10 features dual connector body 12 connected to and extending in line with two-wire lead line 14 leading to a geophone (not shown) Lanyard bore 16 is located in connector body lower portion 18 located below and in line with connector body upper portion 20.

Male connector 22 is located in lower body portion 18 remote from lead line 14 and features male connector body 24 having male contact pin 26 and female contact receptacle 28. Female connector 30 is located in connector body upper portion 20 generally above and in line with lead line 14, facing in the opposite direction to male connector 22. Female connector 30 features female connector body 32 having male contact pin 34 and female contact receptacle 36. It is preferred that male connector 22 be of such dimensions as to be capable of mating the female connector 30 of an identical geophysical dual connector to that described herein.

Figure 3A:
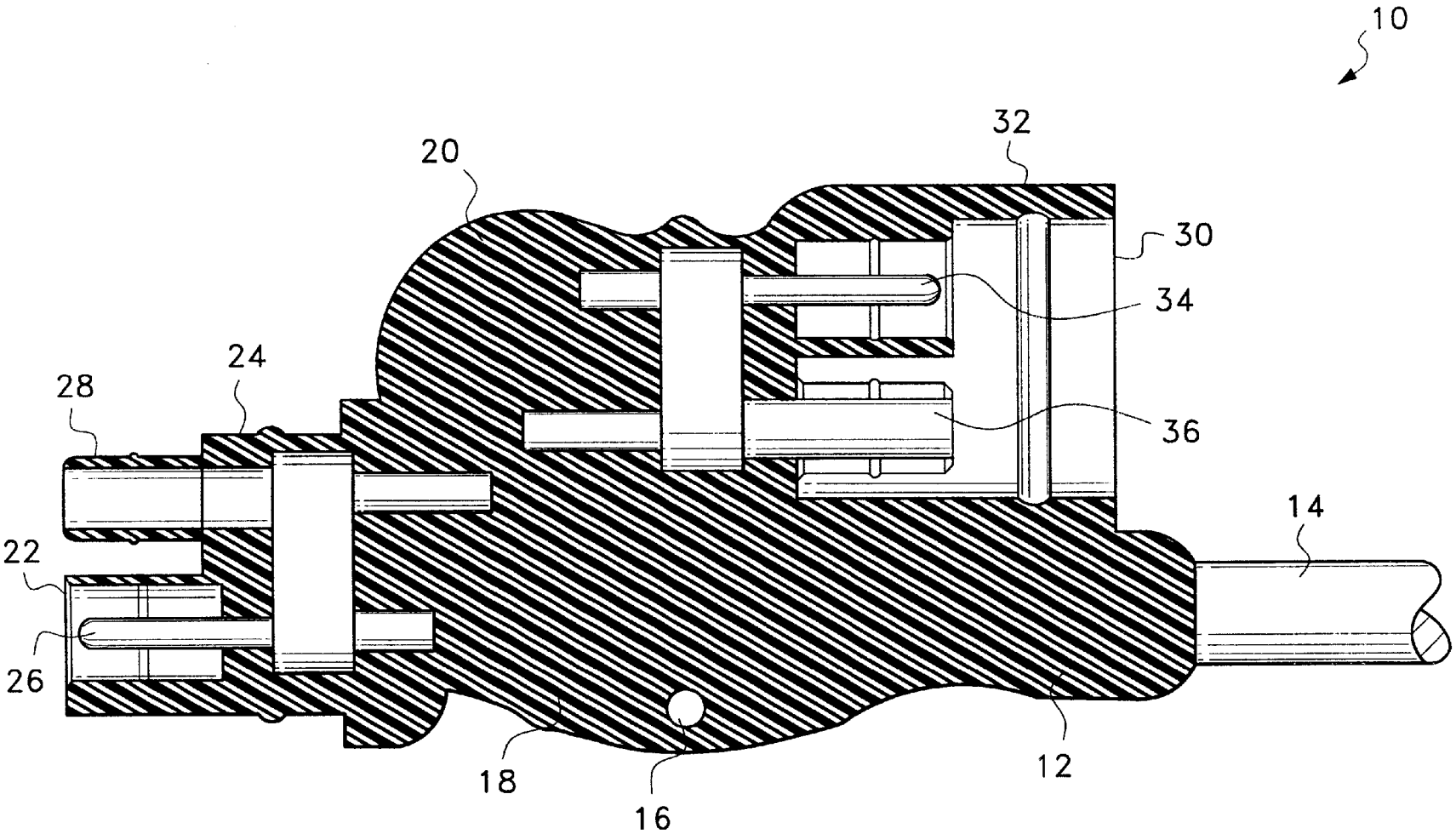
FIG. 3A is a sectional view of the inventive dual connector of FIG. 2 illustrating the arrangement of connector elements.
Figure 3B:
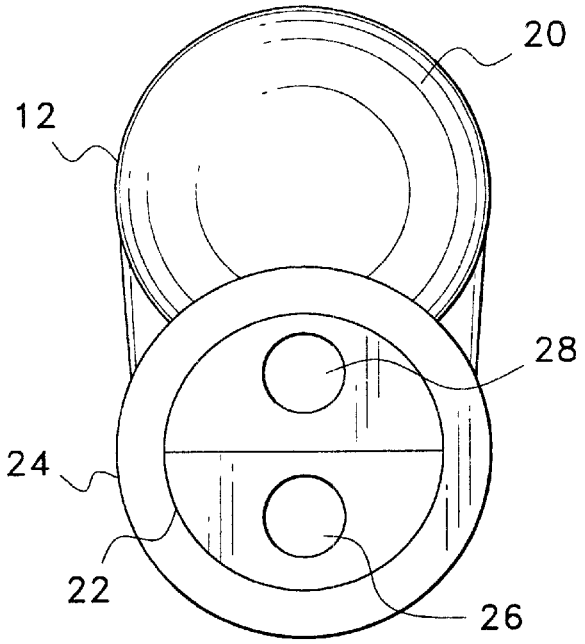
FIG. 3B is an end view of the dual connector of FIG. 2 taken from the male end.
Figure 3C:
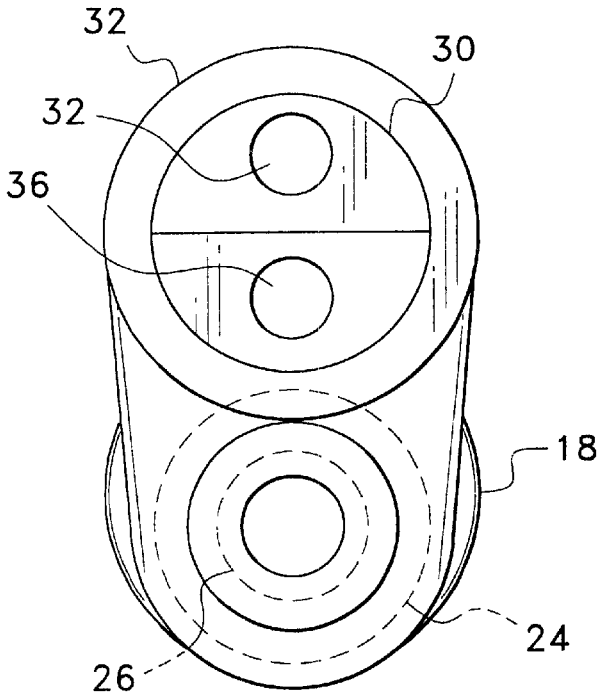
FIG. 3C is an end view of the dual connector of FIG. 2 taken from the female end.
Figure 3D:
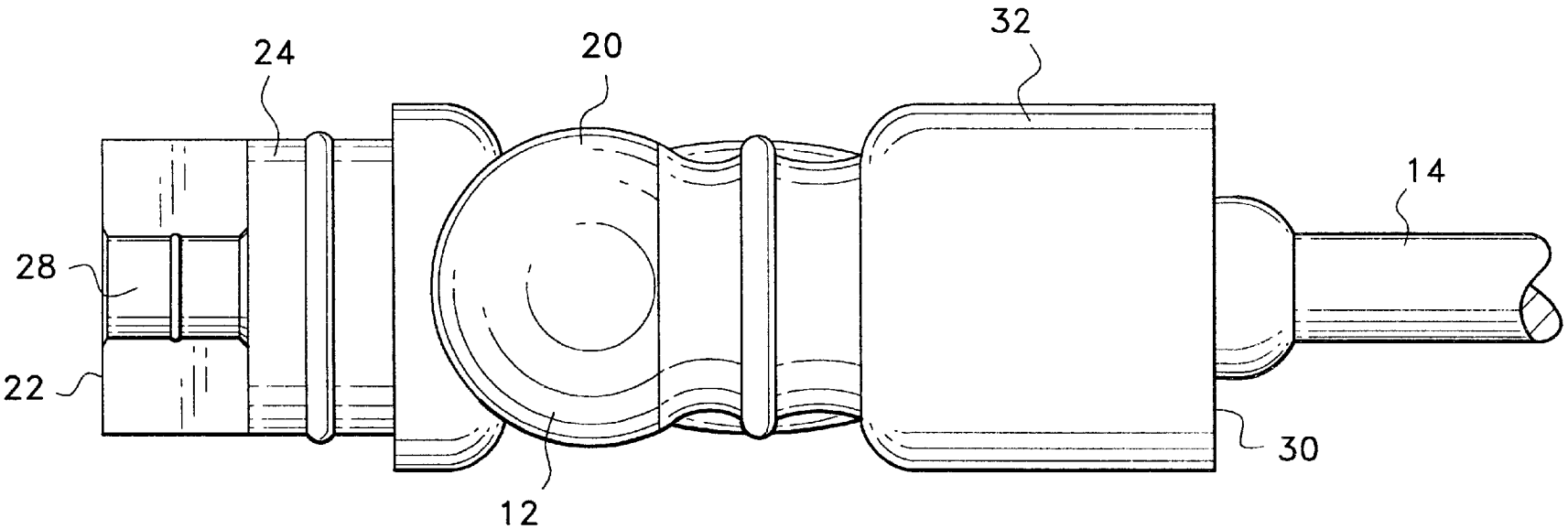
FIG. 3D is a plan view of the dual connector of FIG. 2.
Figure 3E:
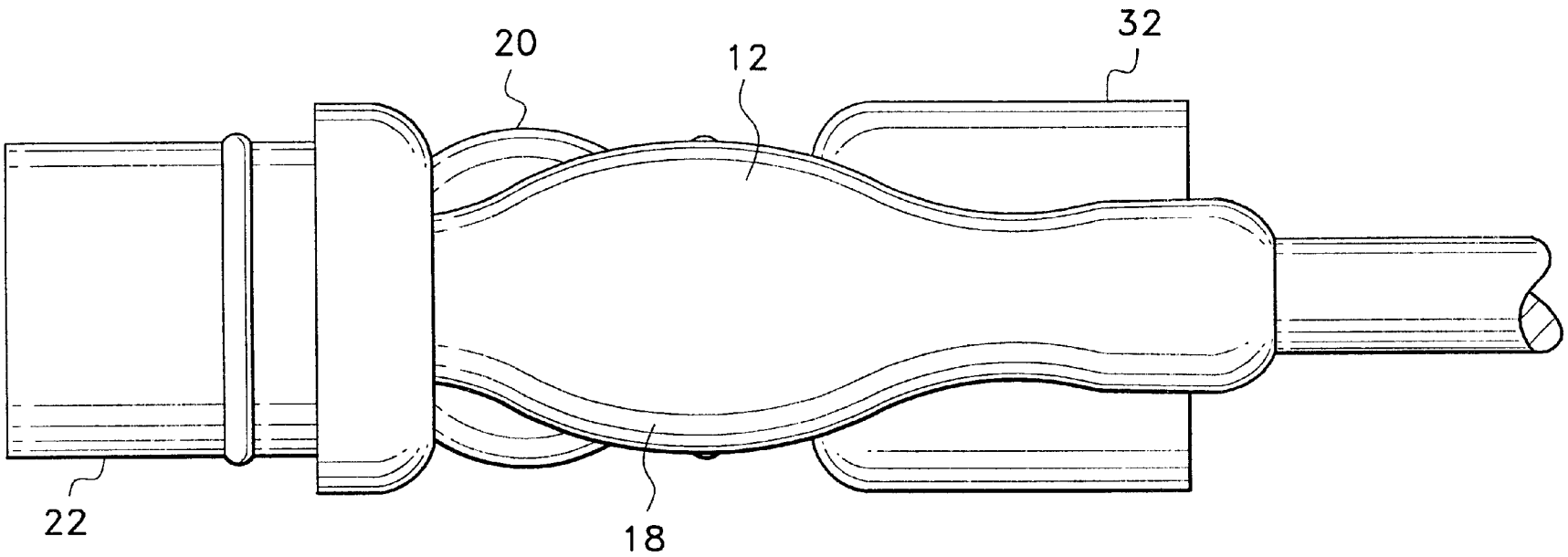
FIG. 3E is as bottom view of the dual connector of FIG. 2.
Figure 3F:
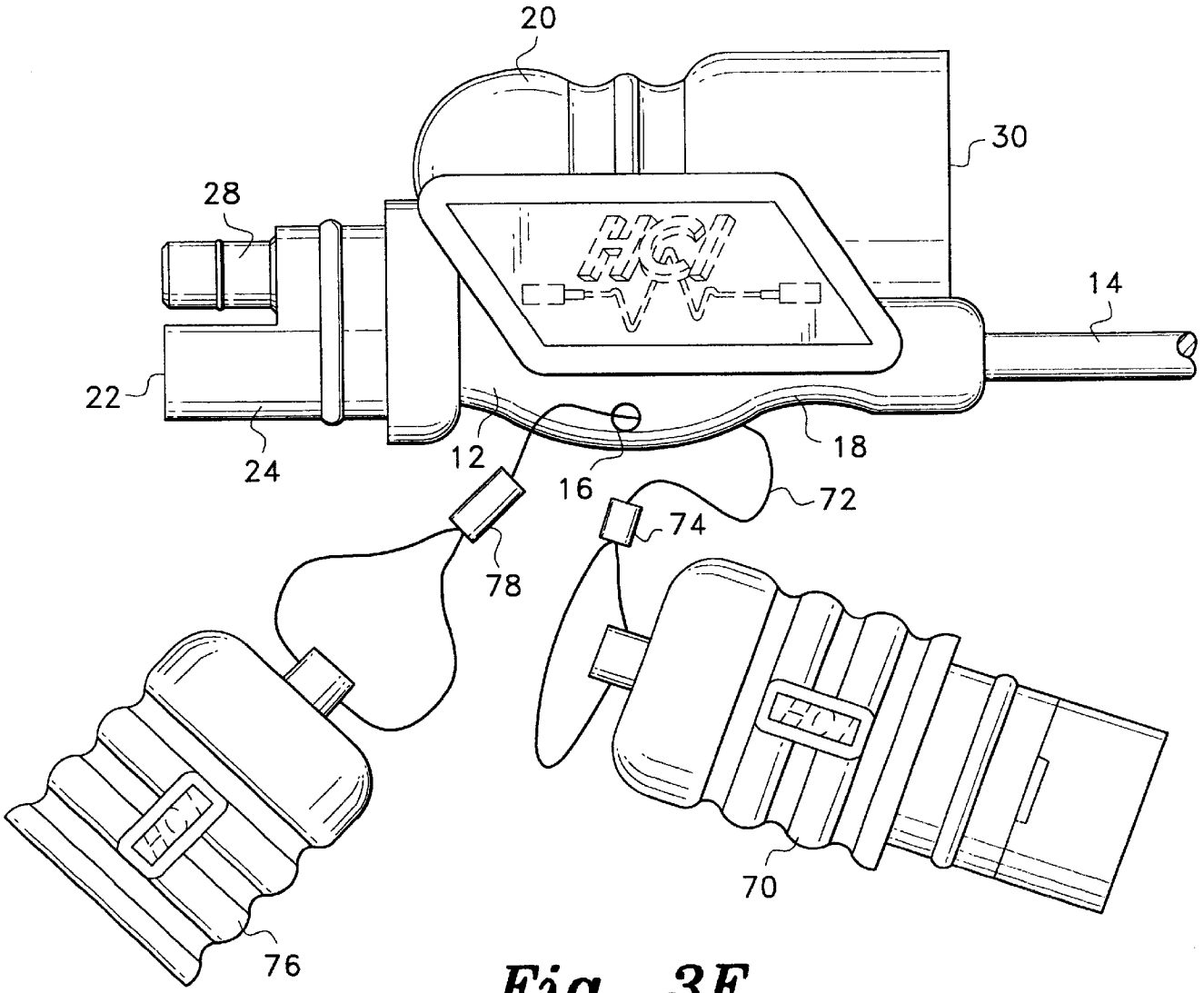
FIG. 3F is a side view in elevation of the dual connector of FIG. 2, showing the lanyard and dust caps.

Referring to FIG. 3F there is shown a side elevation view of geophysical dual connector 10. Geophysical dual connector body 12 comprises connector body lower portion 18 having lanyard bore 16 therethrough. Dust cover 70 for female connector 30 is attached to one end of lanyard 72 by first crimp sleeve 74. Lanyard 72 is threaded through lanyard bore 16 and attaches male dust cover 76 by means of second crimp sleeve 78.

Figure 4:
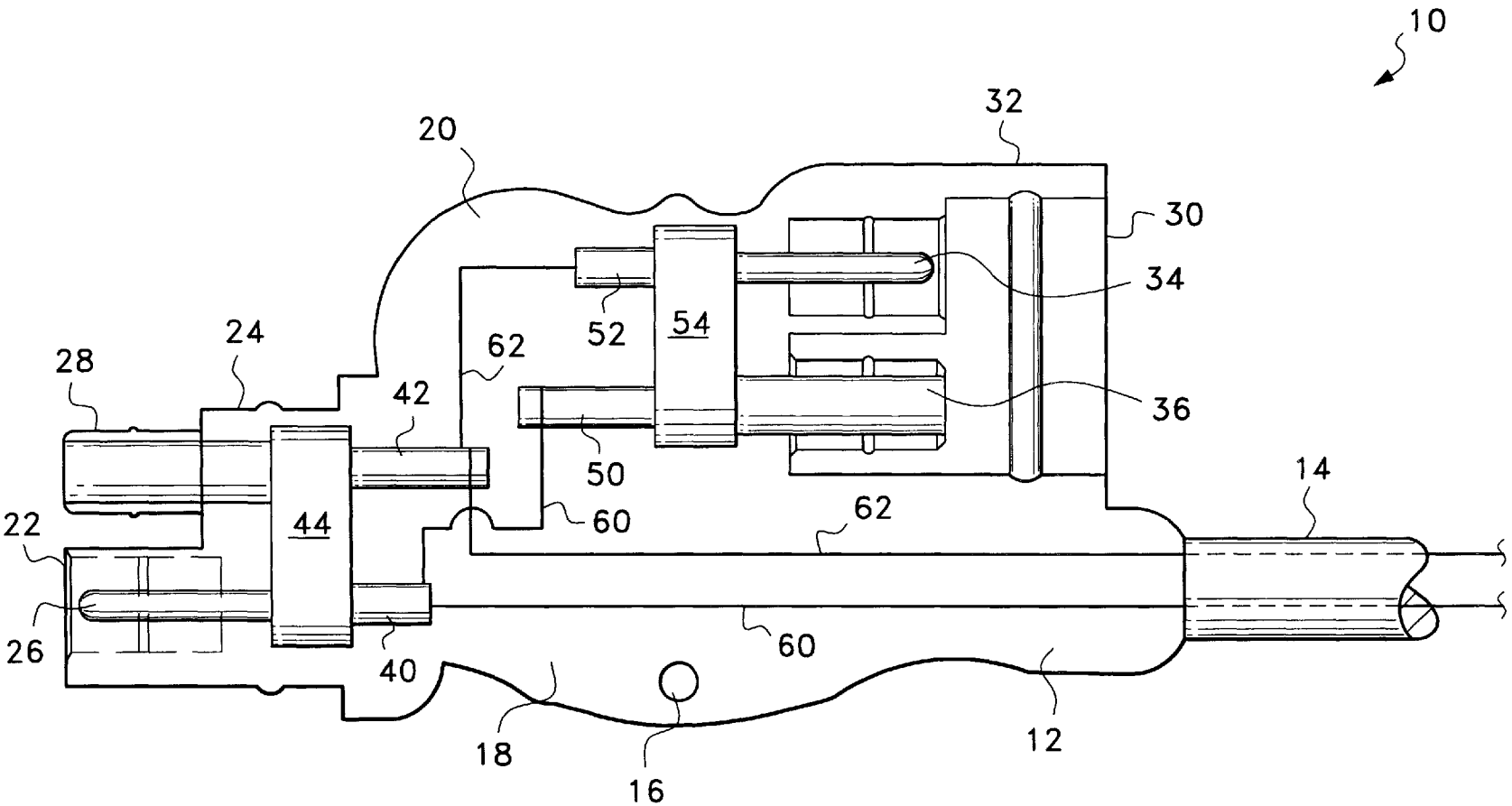
FIG. 4 is an electrical diagram of the dual connector of FIG. 2.

Referring to FIG. 4, there is shown an electrical diagram of the inventive dual connector 10. Dual connector body 12 receives first electrical conduit 60 and second electrical conduit 62 from lead line 14. First male conductor 40 is electrically connected between first electrical conduit 60 and male connector male contact 26. Second male conductor 42 is electrically connected between second electrical conduit 62 and male connector female contact 28. Male conductor separating mounting 44 separates first male conductor 40 and second male conductor 42 and directs them in parallel for connection with male connector male contact 26 and male connector female contact 28, respectively.

First female conductor 50 is electrically connected between first electrical conduit 60 and female connector female contact 36. Second female conductor 52 is electrically connected between second electrical conduit 62 and female connector male contact 34. Female conductor separating mounting 54 separates first female conductor 50 and second female conductor 52 and directs them in parallel for connection with female connector female contact 36 and female connector male contact 34. First electrical conduit 60 and second electrical conduit 60 remain integral and continuous through the above described connections, to improve ruggedness of the inventive design as opposed to the prior art assembly where conduits of lead 14 are spliced to form the separate male connector and female connector. It is further noted that the above-described male and female conductor pairs are physically offset from each other within the inventive dual connector.

Any appropriate insulative material may be used in the formation of the dual connector body of the present invention.

It is to be understood that the present invention is not limited to the embodiment described above, but encompasses any and all embodiments within the scope of the following claims.

I claim:

1. A dual connector for geophysical apparatus comprising:

a) an elongated, unitary body made of an electrical insulating material and having an upper portion and a lower portion;

b) a solid cylindrical male connector plug projecting outwardly from one end of said body and having male and female electrical contacts;

c) a tubular female connector plug projecting outwardly from the opposite end of said body and having male and female electrical contacts;

d) said body portions of said male and female plugs having such dimensions as to snugly accept corresponding female and male plugs, respectively; and e) an electrical lead entering said elongated body and comprising first and second insulated wires, each having an inner end portion and an outer end portion, said inner end portion of said first wire making an electrical connection in series with said male connector male contact and said female connector female contact, said inner portion of said second wire making an electrical connection in series with said male connector female contact and said female connector male f) one of said female and said male plugs being opposed of and in line with said electrical lead upon its entry to said connector body.

2. The dual connector of claim 1, wherein said male plug is opposed to and in line with said electrical lead upon its entry to said connector body.

3. The dual connector of claim 2, wherein said male plug and said electrical lead entry is located in said lower portion of said dual connector body.

4. The dual connector of claim 3, wherein said female plug is located in said upper portion of said dual connector body.

5. The dual connector of claim 1, further comprising a first male conductor, and a second male conductor, said first male conductor being electrically connected between said male connector male contact and said first wire, said second male conductor being electrically connected between said male connector female contact and said second wire.

6. The dual connector of claim 5, further comprising a first female conductor, and a second female conductor, said first female conductor being electrically connected between said female connector female contact and said first wire, said second female conductor being electrically connected between said female connector male contact and said second wire.

7. The dual connector of claim 6, further comprising a male separator mounting separating said first and second male conductors and directing them in parallel for connection with said male connector male contact and said male connector female contact, respectively.

8. The dual connector of claim 7, further comprising a female separator mounting separating said first and second female conductors and directing them in parallel for connection with said female connector male contact and said female connector female contact, respectively.

9. The dual connector of claim 8, wherein said first and second male conductors are spaced and offset in elevation from said first and second female conductors.

10. The dual connector of claim 1, wherein said body portions of said male and female plugs have such dimensions as to snugly accept corresponding female and male plugs, respectively.

11. A dual connector of geophysical apparatus comprising:

a) an elongated, unitary body made of an electrical insulating material and having an upper portion and a lower portion:

b) a solid cylindrical male connector plug projecting outwardly from one end of said body from said lower portion, and having male and female electrical contacts;

c) a tubular female connector plug projecting outwardly from the opposite end of said body from said upper portion and having male and female electrical contacts;

d) an electrical lead entering said elongated body opposite and in line with said male connector plug and comprising first and second insulated wires having an inner end portion and an outer end portion, said inner end portion of said first wire making an electrical connection in series with said male connector male contact and said female connector female contact, said inner portion of said second wire making an electrical connection in series with said male connector female contact and said female connector male contact;

e) a first male conductor, and a second male conductor, said first male conductor being electrically connected between said male connector male contact and said first wire, said second male conductor being electrically connected between said male connector female contact and said second wire;

f) a first female conductor, and a second female conductor, said first female conductor being electrically connected between said female connector female contact and said first wire, said second female conductor being electrically connected between said female connector male contact and said second wire;

g) said first and second male conductors being spaced and offset in elevation from said first and second female conductors.

12. The dual connector of claim 11, wherein said body portions of said male and female plugs have such dimensions as to snugly accept corresponding female and male plugs, respectively.

13. The dual connector of claim 11, further comprising a male separator mounting separating said first and second male conductors and directing them in parallel for connection with said male connector male contact and said male connector female contact, respectively.

14. The dual connector of claim 13, further comprising a female separator mounting separating said first and second female conductors and directing them in parallel for connection with said female connector male contact and said female connector female contact, respectively.

* * * * *